US006676418B2

(12) United States Patent
Watanabe

(10) Patent No.: US 6,676,418 B2
(45) Date of Patent: Jan. 13, 2004

(54) SOCKET FOR ELECTRICAL PARTS

(75) Inventor: Tsuyoshi Watanabe, Kawaguchi (JP)

(73) Assignee: Enplas Corporation, Saitama-Ken (JP)

( * ) Notice: Subject to any disclaimer, the term of this patent is extended or adjusted under 35 U.S.C. 154(b) by 0 days.

(21) Appl. No.: 10/157,841

(22) Filed: May 31, 2002

(65) Prior Publication Data

US 2002/0182919 A1 Dec. 5, 2002

(30) Foreign Application Priority Data

May 31, 2001 (JP) ..... 2001-164295

(51) Int. Cl.[7] ..... H01R 9/09
(52) U.S. Cl. ..... 439/71; 439/70; 439/342
(58) Field of Search ..... 439/342, 70, 71, 439/331, 66, 259–265

(56) References Cited

U.S. PATENT DOCUMENTS 5,243,757 A * 9/1993 Grabbe et al. ..... 29/882
5,248,262 A 9/1993 Busacco et al. ..... 439/66
5,611,705 A * 3/1997 Pfaff ..... 439/266
5,829,988 A * 11/1998 McMillan et al. ..... 439/70
6,083,013 A * 7/2000 Yamagishi ..... 439/71

FOREIGN PATENT DOCUMENTS

JP 6-89764 3/1994

* cited by examiner

*Primary Examiner*—Alexander Gilman
(74) *Attorney, Agent, or Firm*—Staas & Halsey LLP

(57) ABSTRACT

An IC socket of the present invention has a socket body on which a contact pin is provided. The contact pin has an elastically deformable spring portion between an upper end portion and a lower end portion. An elastic deformation portion having an engaging portion at its endmost portion. The socket body has an upper through hole into which the upper end portion of the contact pin is inserted, and a lower through hole into which the lower end portion of the contact pin is inserted. The contact pin can be installed into the socket body by inserting the lower end portion thereof via the upper through hole into the lower through hole, then inserting the upper end portion thereof into the upper through hole with the elastic deformation portion deformed, and then releasing the deformation of the elastic deformation portion at the time the insertion is completed, finally the engaging portion engaging with a lower surface portion of a peripheral portion of the upper through hole, to prevent the contact pin from being fallen out through the upper through hole.

6 Claims, 15 Drawing Sheets

PRIOR ART

SOCKET FOR ELECTRICAL PARTS

BACKGROUND OF THE INVENTION

1. Field of the Invention

The present invention relates to a socket for electrical parts for detachably accommodating an electrical parts such as a semiconductor device or the like (hereinafter referred to as "IC package"), more particularly relates to a socket for electrical parts capable of easily replacing a contact pin that contacts with or separates from a terminal of the electrical parts.

2. Prior Art of the Invention

Conventionally, an IC socket as a "socket for electrical parts" is previously mounted on a circuit board and then accommodates an IC package on the IC socket, achieving an electrical contact between the IC package and the circuit board.

As for the IC packages, for example, those having numbers of terminals on a lower surface of a rectangular type package body have been exemplified.

Each of these terminals of the IC package is brought to electrically contact with said circuit board via each contact pin, by making each of the terminals of the IC package contact with an upper portion of the contact pin in the IC socket while the IC package is held on the IC socket.

As typically shown in FIGS. 21A and 21B, the contact pin 1 comprises an upper end portion 1*a* that abuts against and contacts with the terminal of the IC package, a lower end portion 1*b* that abuts against and contacts with the circuit board and an approximately arcuate and elastically deformable elastic portion 1*c* between the upper portion 1*a* and the lower portion 1*b*.

The upper portion 1*a* is inserted into an upper through hole 3*a* formed to a floating plate 3 of the socket body 2 and the lower portion 1*b* is inserted into an lower through hole 4*a* formed to a base portion 4 of the socket body 2. The upper and lower portions each contact with the IC package and the circuit board under a prescribed contact pressure respectively, while the elastic portion 1*c* is elastically deformed. And the contact pin 1 is formed with a projection 1*d* for preventing the contact pin 1 from dropping out.

In such an IC socket mentioned above, two major processes described below have been conceived when there is a need to replace the contact pin 1.

(1) At first, the base portion 4 and the floating plate 3 are taken apart, and then the contact pin 1 is taken out or inserted.

(2) At first, a damaged contact pin 1 is forcibly taken out without taking apart the base portion 4 and the floating plate 3, and then a new contact pin 1 is forcibly inserted.

The foregoing conventional processes have following disadvantages. That is, in the above mentioned process (1), there is certainly no need to apply too much force in taking out or inserting the contact pin 1. But at the time when the floating plate 3 is made to attach to the base portion 4, the process of inserting all contact pins 1 into the upper through holes 3*a* of the floating plate 3 must be done, being a difficult process. On the other hand, in the above mentioned process (2), damages may occur at a peripheral portion of the upper through hole 3*a* of the floating plate 3 at the time the contact pin 1 is forcibly taken out upwardly, and plastic deformation also may occur at the projection 1d at the time when the contact pin 1 is forcibly inserted, because there is the peripheral portion around the upper through hole 3*a* of the floating plate 3. Therefore, forcible insertion or takeout of the contact pin 1 is a difficult process in replacing the contact pin 1.

Accordingly, when only one or a few contact pins are damaged among numbers of them, the IC socket itself having a damaged contact pin must be replaced with a new one, being inconvenient and expensive.

The processes of this kind are described in Japanese Patent Publication No. Tokkai Hei 6-89764.

SUMMARY OF THE INVENTION

An object of the present invention is aimed at substantially eliminating defects or drawbacks encountered in the prior art mentioned above and to provide a socket for electrical parts capable of easily replacing even only one of the contact pins without disassembling the socket body itself.

In order to achieve this or other objects of the present invention, an aspect of the present invention is that a socket for electrical parts comprises:

- a socket body on which an electrical part is accommodated; and
- a contact pin provided to the socket body,
- the contact pin comprising;
  - an upper end portion to contact with a terminal of the electrical part,
  - a lower end portion to electrically contact with a circuit board,
  - an elastically deformable spring portion between the upper end portion and the lower end portion,
  - an elastic deformation portion formed in the upper end portion, and
  - an engaging portion formed on an end most portion of the elastic deformation portion,
- the socket body comprising;
  - an upper through hole into which the upper end portion of the contact pin is inserted, and
  - a lower through hole into which the lower portion of the contact pin is inserted,
- the contact pin being able to be installed in the socket body by inserting the lower end portion thereof via the upper through hole into the lower through hole, then inserting the upper end portion thereof into the upper through hole with the elastic deformation portion deformed, and then releasing the deformation of the elastic deformation portion at the time the insertion is completed, finally the engaging portion engaging with a lower surface portion of a peripheral portion of the upper through hole, to prevent the contact pin from being fallen out from the upper through hole.

According to the foregoing aspect of the present invention, elastic deformation at the elastic deformation portion of the contact pin allows the contact pin to be easily driven into or taken out of the socket body without dismantling the socket body, so that even only one of the contact pins can be easily replaced.

Another aspect of the present invention is that a contact surface portion extending in an approximately horizontal direction is provided on the upper end portion to abut against a spherical terminal of the electrical part, and a recess portion is provided on the contact surface portion to prevent a lower end portion of the spherical terminal from abutting against the contact surface portion.

According to the foregoing aspect of the present invention, since the recess portion is provided on the contact surface portion of the contact pin, the lowermost portion of the round shaped terminal of the electrical part is kept from being damaged.

Another aspect of the present invention is that the recess portion of the upper end portion of the contact pin has an ellipsoidal shape elongated in the bending direction of the spring portion.

According to the foregoing aspect of the present invention, when the contact surface portion of the contact pin is urged downwards with the round shaped terminal of the electric part being driven into the ellipsoidal recess of the contact pin, the contact surface portion is displaced. As the ellipsoidal recess is made elongated along the displacement direction, the round shaped terminal moves within the range of the ellipsoidal recess in a relative displacement manner with respect to the recess, resulting in that the displacement is allowed. Therefore, an unnecessary or excessive force does not apply on the round shaped terminal or the contact pin etc. In addition, a wiping effect can be exerted because the round shaped terminal slides within the recess in the relative displacement manner.

Another aspect of the present invention is that the contact surface portion extending in an approximately horizontal direction is provided on the upper end portion to abut against a plane like terminal of the electrical part, and a projection is provided on the contact surface portion to abut against the plane like terminal.

Still another aspect of the present invention is that an inclined guide portion is further provided at the upper peripheral portion of the lower through hole of the socket body, to help guide the lower end portion of the contact pin into the lower through hole.

According to the foregoing aspect of the present invention, the lower end portion of the contact pin can be easily inserted into the lower side through hole since the inclined guide portion is provided at the upper peripheral portion of the lower side through hole.

BRIEF DESCRIPTION OF THE DRAWINGS

In the accompanying drawings:

FIG. 6A is a front view of the contact pin; FIG. 6B is a plan view of FIG. 6A; and FIG. 6C is a right side view of FIG. 6A;

FIG. 9A is an enlarged view of X portion in FIG. 7; FIG. 9B is a cross sectional view taken along the line IXB—IXB in FIG. 9A; FIG. 9C is a cross sectional view taken along the line IXC—IXC in FIG. 9A; and FIG. 9D is an enlarged view of FIG. 9C, where the contact pin is inserted;

FIG. 12A is an enlarged view of Y portion in FIG. 10 and FIG. 12B is a cross sectional view taken along the line XIIB—XIIB in FIG. 12A;

FIG. 17A is a front view of the IC package and FIG. 17B is a bottom view of the IC package respectively;

FIG. 18A is a front view of the contact pin and FIG. 18B is a plan view of FIG. 18A respectively;

FIG. 19A is a front view of the contact pin and FIG. 19B is a plan view of FIG. 19A, respectively;

FIG. 20A is a front view of the contact pin and FIG. 20B is a plan view of FIG. 20A respectively; FIG. 21A is a cross sectional view showing an outline of an arranged state of the contact pin and FIG. 21B is a cross sectional view taken along the line XXIB—XXIB in FIG. 21A, respectively.

DESCRIPTION OF THE PREFERRED EMBODIMENTS

Preferred embodiments or best mode of the present invention will be described hereunder with reference to the accompanying drawings.

First Embodiment

FIG. 1 to FIG. 17B show the first embodiment of the present invention.

First, a structure will be explained. In figures, reference number 11 shows an IC socket as a "socket for electrical parts." The IC socket 11 is used for carrying out a performance test of the IC package 12 and for establishing an electrical contact between a solder ball 12*b* as a "spherical terminal" of an IC package 12 and a circuit board P on the side of an IC test equipment.

Figure 17A:
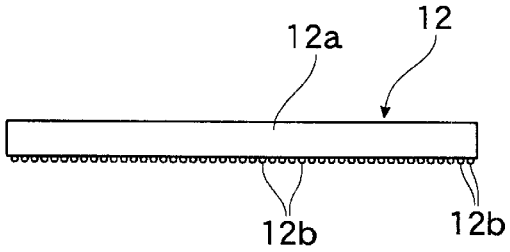
FIGS. 17A and 17B are view showing the IC package to be accommodated on the IC socket in the first embodiment.
Figure 17B:
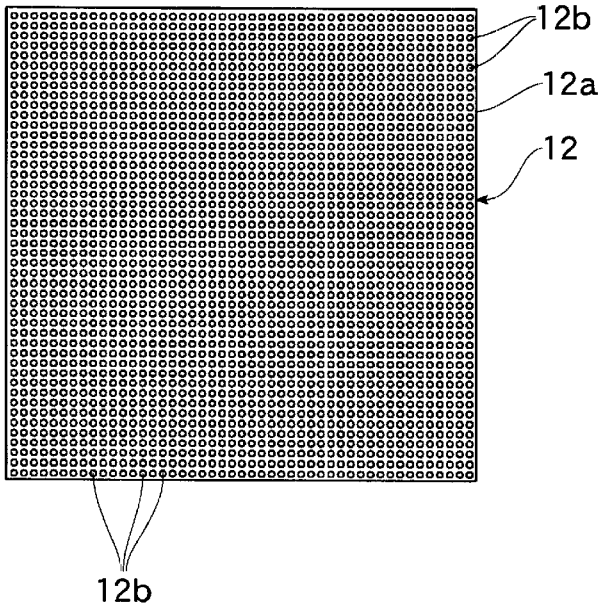

The IC package 12 is the so-called BGA (Ball Grid Array), and as shown in FIGS. 17A and 17B, numbers of solder balls 12*b* are formed in a matrix like manner on a lower surface of a square like package body 12*a*.

The IC socket 11 comprises, as typically shown in FIG. 1 to FIG. 4, a socket body 13 disposed on the circuit board P such as a burn-in board or the like, and a contact pin 14 disposed in the socket body 13 to be contacted with the solder ball 12*b*.

Figure 6B:
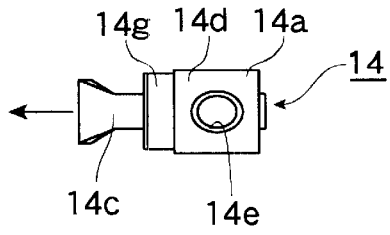
FIG. 6A, 6B and 6C show the contact pin of the IC socket of the first embodiment.
Figure 6A:
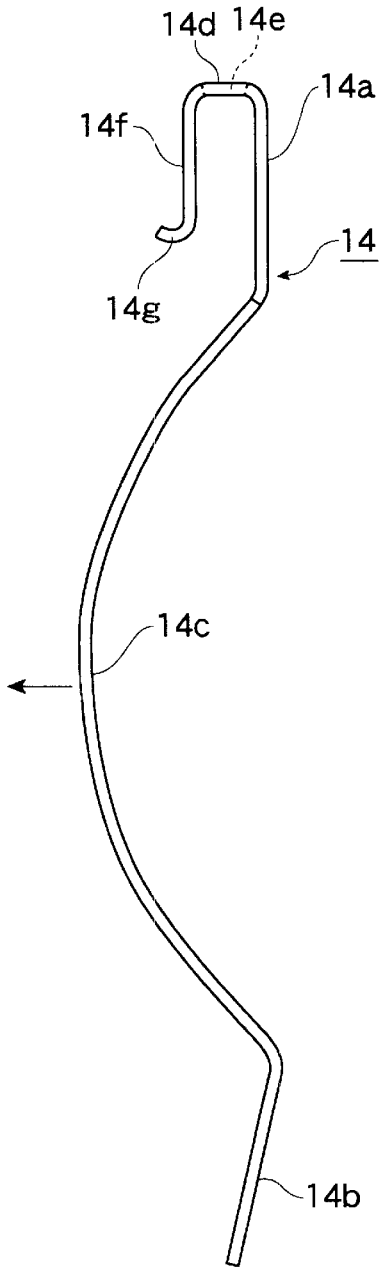
Figure 6C:
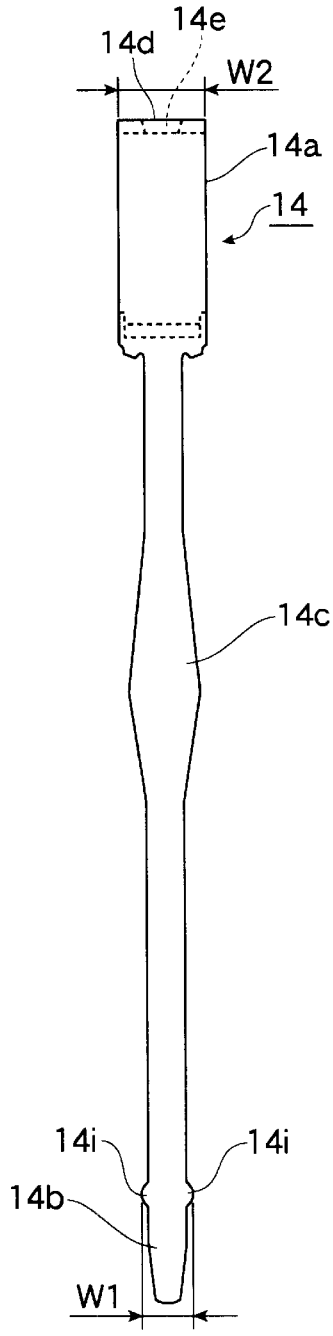
Figure 7:
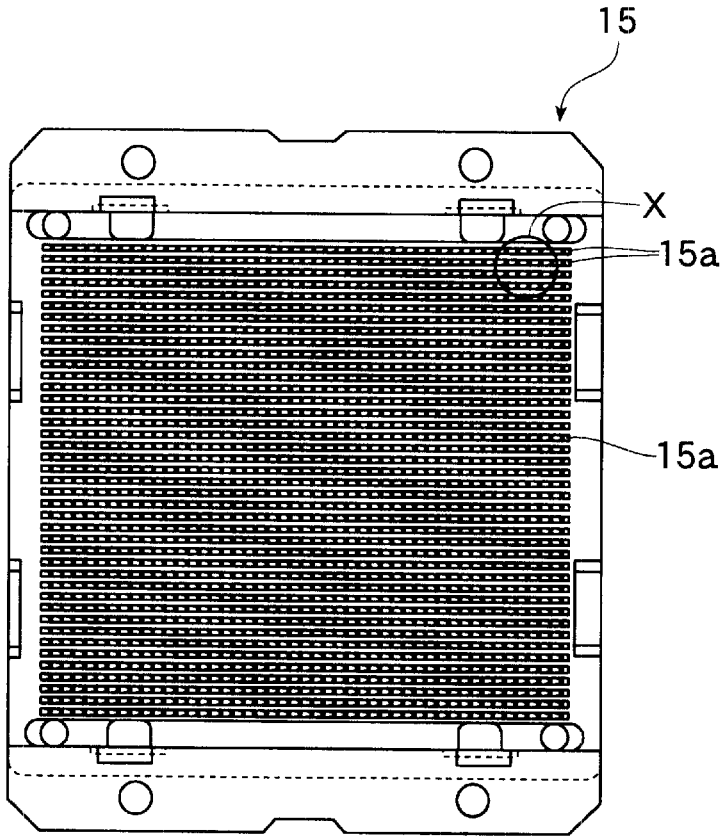
FIG. 7 is a plan view of a base portion of the socket body of the IC socket of the first embodiment.
Figure 8:
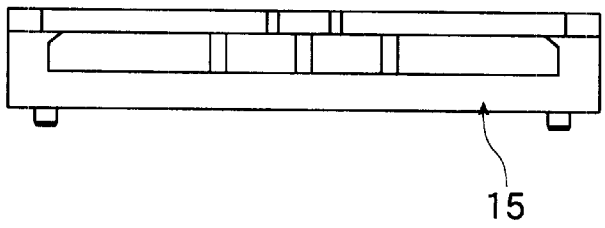
FIG. 8 is a front view of the base portion of the socket body of the IC socket of the first embodiment.

The contact pin 14, as shown in FIG. 6A, 6B and 6C, can be produced, for example, through a process of folding a long plate-like electrically conductive material using press working, and then forming, between an upper end portion 14*a* and a lower end portion 14*b*, a spring portion 14*c*, which is capable of being bent in a direction (arrow direction as shown in FIG. 6A).

A contact surface portion 14*d* extending approximately in a horizontal direction is formed on the upper end portion 14*a* and contacts with and separates from the solder ball 12*b* of the IC package 12. As shown in FIG. 6B, an ellipsoidal recess (recess portion) 14*e* elongated in a bending direction of a spring portion 14*c* (arrow direction in FIG. 6B) is provided on the contact surface portion 14*d* in order to prevent a lower most portion of the solder ball 12*b* from contacting with the contact surface portion 14*d*. The length of the minor axis of the ellipsoidal recess is made shorter than the outer diameter of the solder ball 12*b*.

An elastic deformation portion 14*f* extends downwards from the contact surface portion 14*d*, and a lower end portion (endmost portion) of the elastic deformation portion 14*f* has a collar-like engaging portion 14*g* that is folded back.

Furthermore, a positioning projection 14*i* for controlling a lower most position of the contact pin 14 is formed, as shown in FIG. 6A, 6B, 6C, FIG. 9A, 9B, 9C and 9D, on the lower end portion 14*b* of the contact pin 14, and engages with a lower through hole 15*a* of a base portion 15 as described later. The outer width W1 of the projection 14*i*, as shown in FIG. 6C, is formed narrower than the width W2 of the contact surface portion 14*d*.

Figure 4:
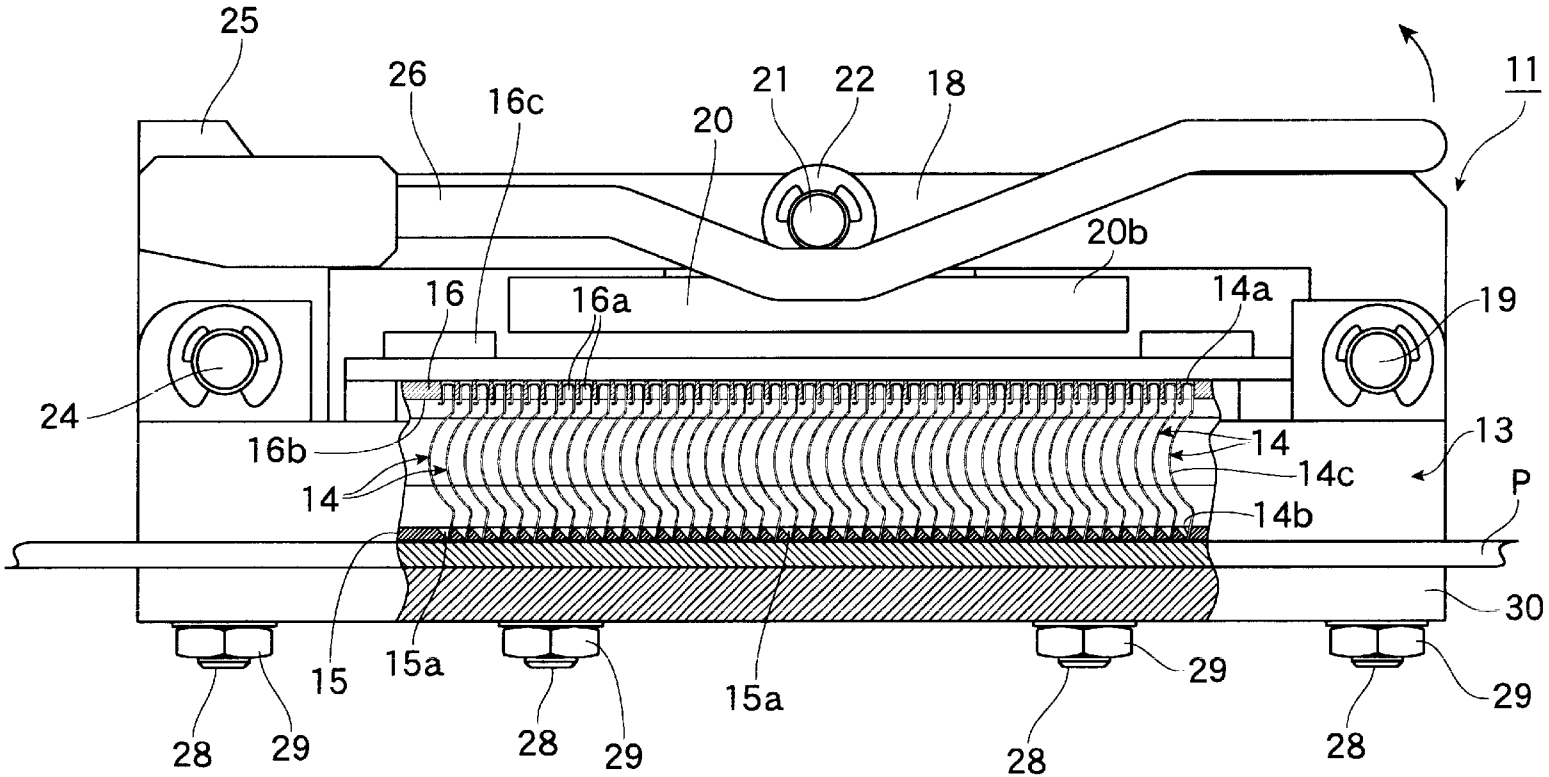
FIG. 4 is a front view of the IC socket of the first embodiment, a portion where contact pins are disposed is cut away.

The socket body 13, as shown in FIG. 4 etc., comprises a base portion 15 to be mounted on the circuit board P. and a floating plate 16 disposed at a prescribed distance from and over the base portion 15. The lower through hole 15*a* into which the lower end portion 14*b* of the contact pin 14 is to be inserted, is formed to the base portion 15, as shown in FIG. 7 to FIG. 9A, 9B, 9C and 9D.

Figure 1:
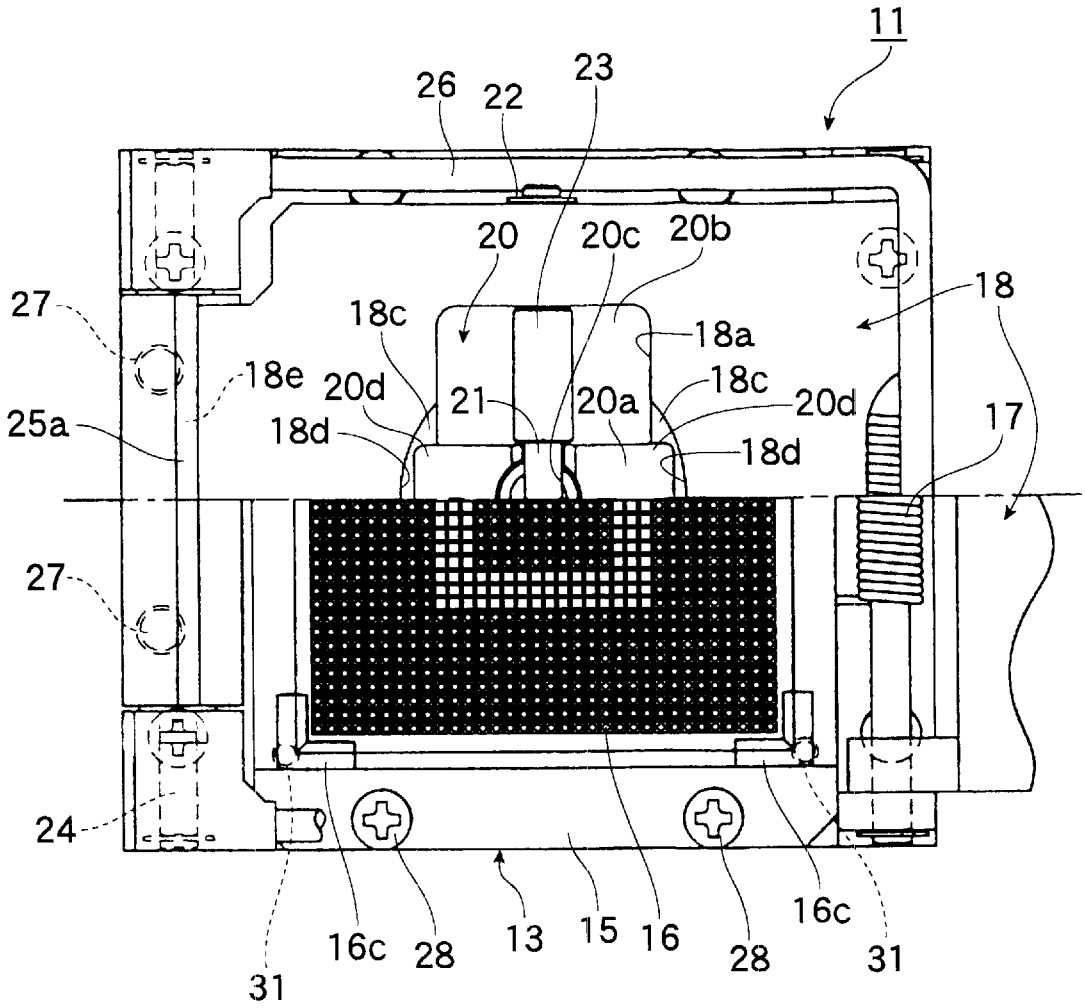
FIG. 1 is a plan view of an open/close member of an IC socket of a first embodiment of the present invention, a lower half of an open/close member being opened.
Figure 12A:
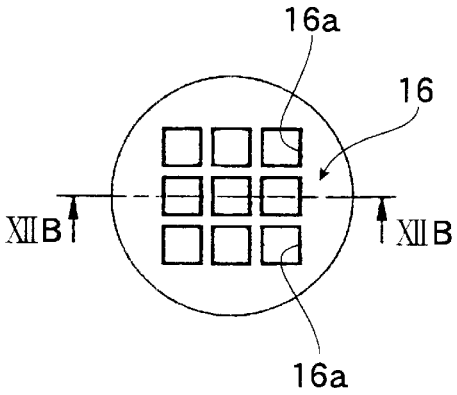
FIGS. 12A and 12B are enlarged views of a part of the floating plate of the socket body of the IC socket in the first embodiment.
Figure 12B:
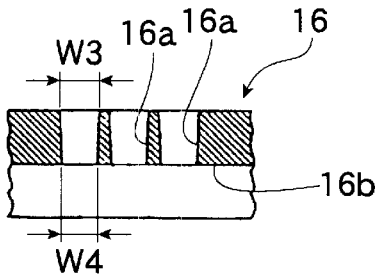

The floating plate 16, as shown in FIG. 1, is urged toward upper side by a spring 31 and can be moved vertically with respect to the base portion 15. An upper through hole 16*a* into which the upper portion 14*a* of the contact pin 14 is inserted, is formed to the floating plate 16, as shown in FIG. 10 to FIG. 12A and FIG. 12B. The upper through hole 16*a* has an upper surface side diameter W3 that is lager than a lower surface portion 16*b* side diameter W4, as shown in FIG. 12B. Furthermore, a frame-like guide member having a guide portion 16*c* which determines a position of the IC package 12, is embedded to the floating plate 16, as shown in FIG. 1.

Figure 5:
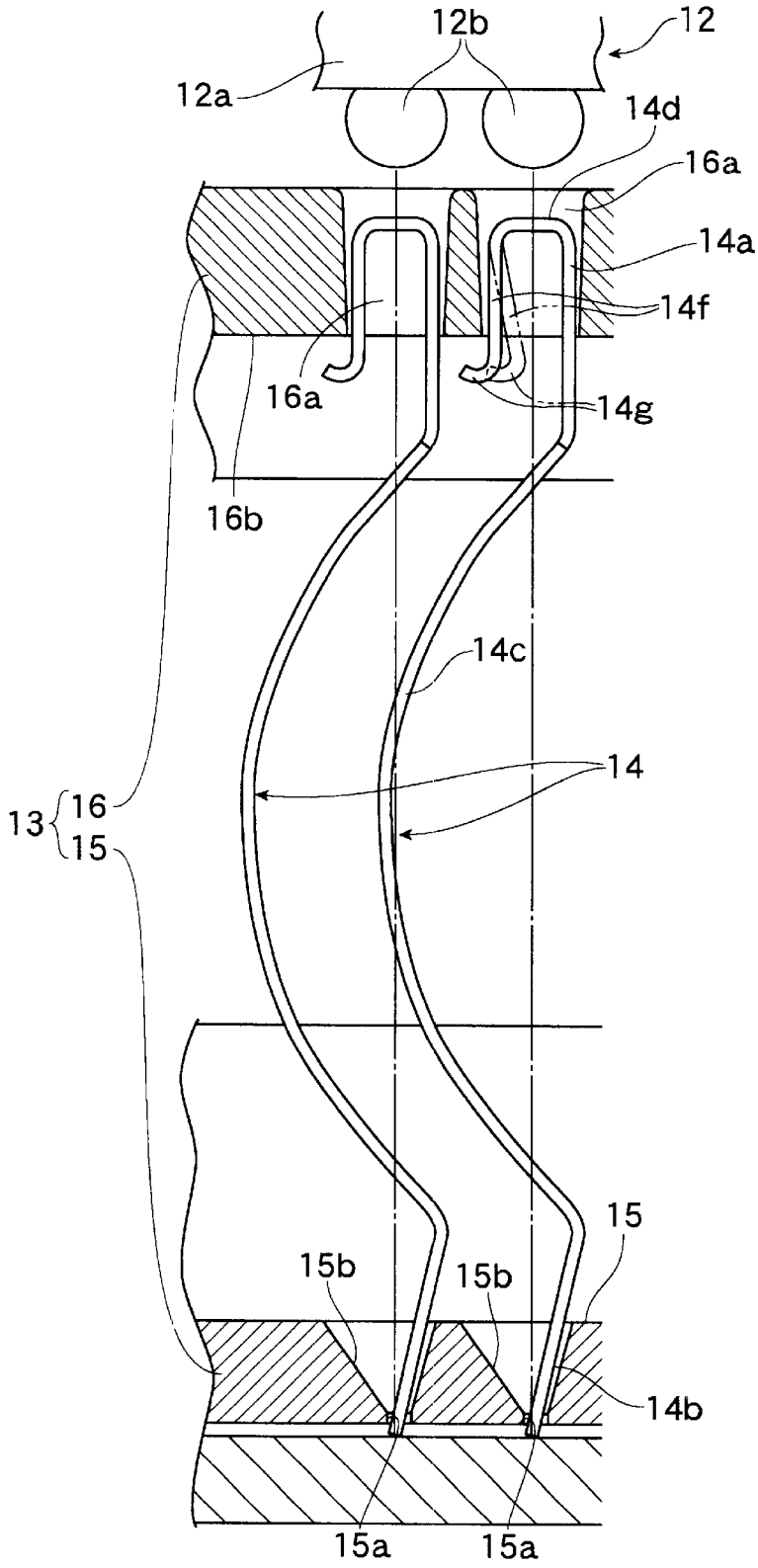
FIG. 5 is an enlarged cross sectional view of the portion where contact pins are disposed in FIG. 4.

The spring portion 14*c* of the contact pin 14 is, as shown in FIG. 5, disposed between the base portion 15 and the floating plate 16. The upper end portion 14*a* of the contact pin 14 is inserted into the upper through hole 16*a* of the floating plate 16, and the lower end portion 14*b* of the contact pin 14 is inserted into the lower through hole 15*a* of the base portion 15, respectively.

That is, the lower end portion 14*b* of the contact pin 14 is at first inserted into the upper through hole 16*a* and then into the lower through hole 15*a*. The upper end portion 14*a* of the contact pin 14 is inserted into the upper through hole 16*a* with the elastic deformation portion 14*f* elastically deformed as shown by a long dashed two short dashed line in FIG. 5. In addition, at a state of completion of the insertion, the elastic deformation at the elastic deformation portion 14*f* is released and then the elastic deformation portion 14*f* returns to the original position so that upward dropout of the contact pin 14 from the socket body 13 can be prevented even if the contact pin 14 is pushed upwardly, because the collar-like engaging portion 14*g* engages with the lower surface portion 16*b* of the peripheral portion of the upper through hole 16*a*.

And at an upper peripheral portion of the lower through hole 15*a* of the base portion 15, an inclined guide portion 15*b* is formed to help guide and insert the lower end portion 14*b* of the contact pin 14 into the lower through hole 15*a*.

Figure 9A:
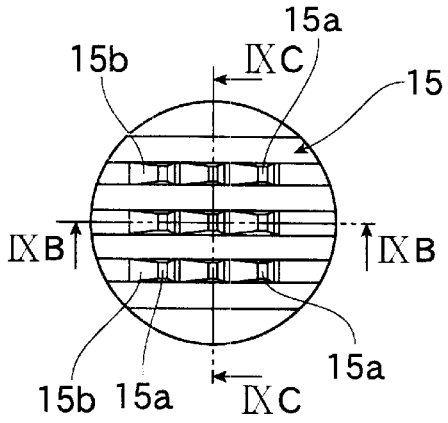
FIG. 9A, 9B, 9C and 9D are enlarged views of a part of the base portion of the socket body of the IC socket in the first embodiment.
Figure 9B:
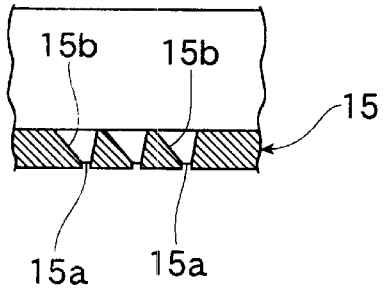
Figure 9C:
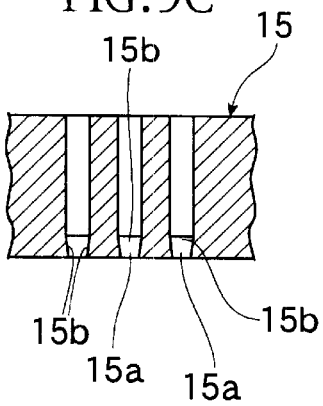
Figure 9D:
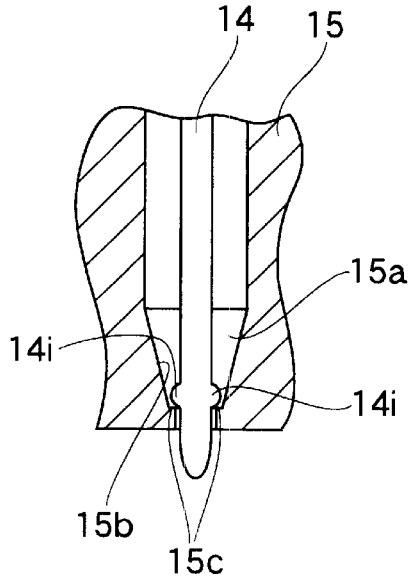
Figure 10:
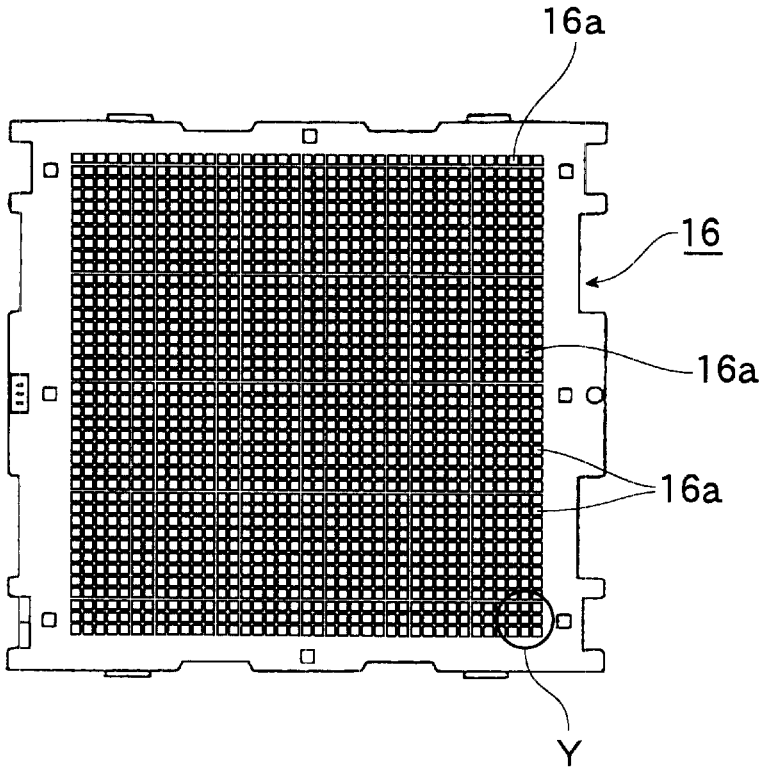
FIG. 10 is a plan view of a floating plate of the first embodiment, where a guide portion of the socket body of the IC socket is omitted.
Figure 11:
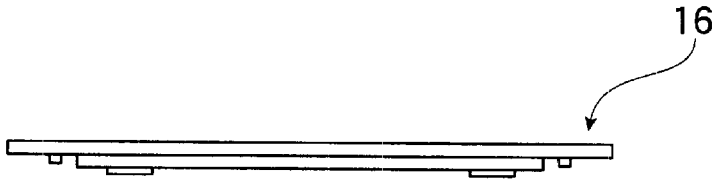
FIG. 11 is a front view of the floating plate of the first embodiment, where the guide portion of the socket body of the IC socket is omitted.

Furthermore, at the lower through hole 15*a*, as shown in FIG. 9D, a stepped portion 15*c* is formed to engage with the positioning projection 14*i* of the contact pin 14. The positioning projection 14*i* of the contact pin 14 abuts against the stepped portion 15*c* so that the lowermost position of the contact pin 14 can be controlled.

At the side of the base portion 15 of the socket body 13, as shown in FIG. 1 to FIG. 4, an open/close member 18 is mounted rotatably on an axis 19, and urged toward opening direction thereof by a spring 17. A press member 20 is attached to the open/close member 18 to press the IC package 12.

Figure 13:
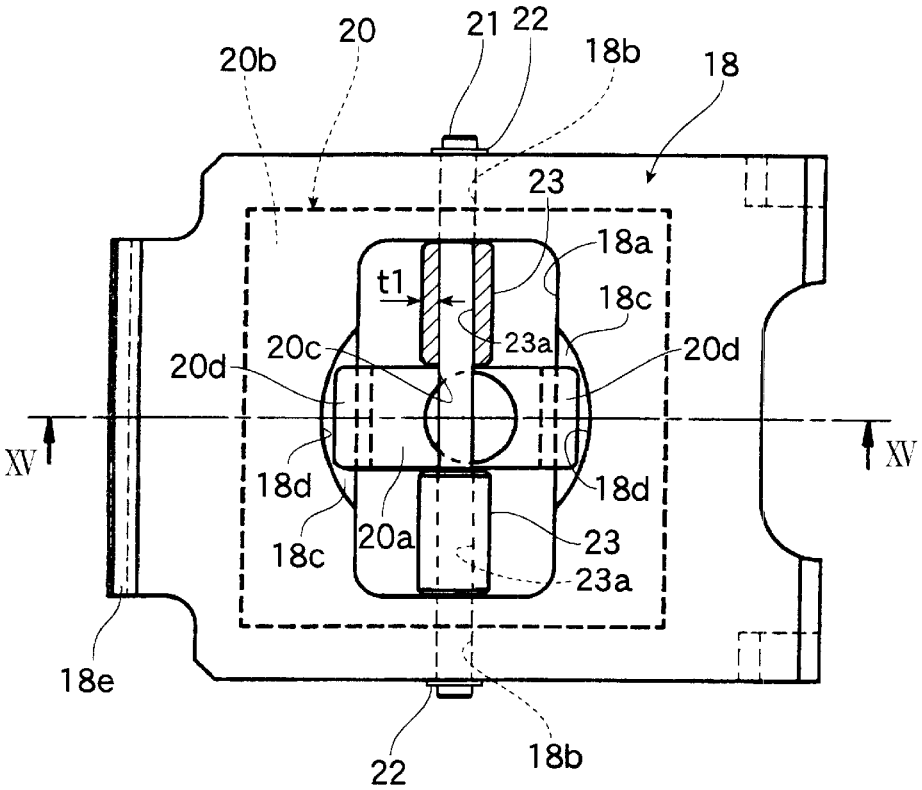
FIG. 13 is a plan view showing the open/close member and the pressing member etc. of the IC socket of the first embodiment.
Figure 15:
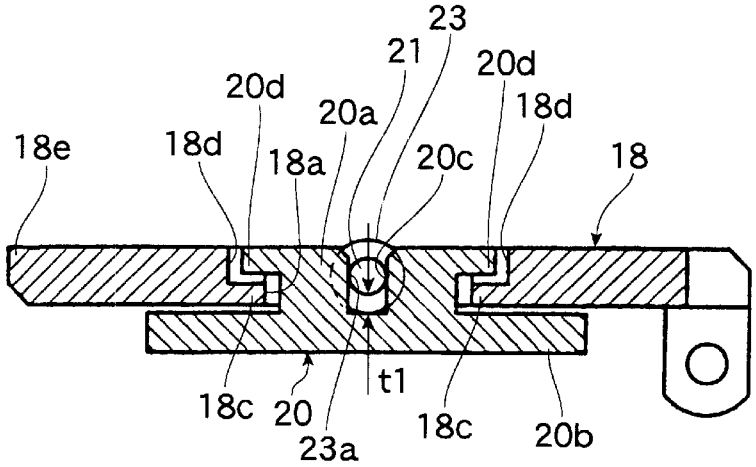
FIG. 15 is a cross sectional view taken along the line XV—XV in FIG. 13 of the first embodiment.
Figure 16:
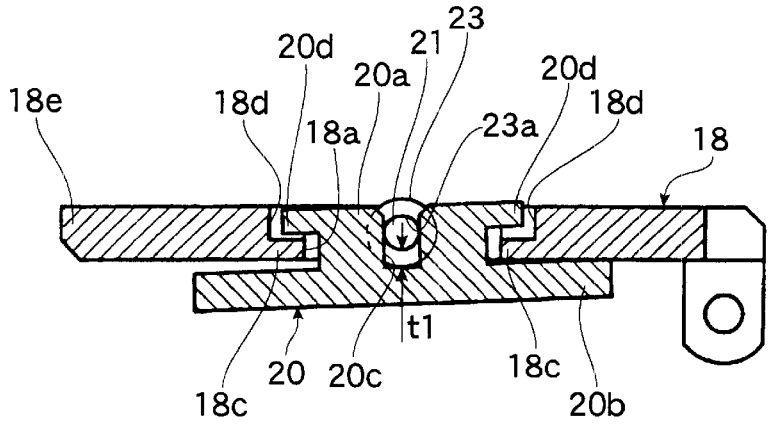
FIG. 16 is a cross sectional view corresponding to FIG. 15, where the pressing member of the IC socket of the first embodiment is slanted.

As shown in FIG. 13 and FIG. 15, an opening 18*a* having a rectangular shape is formed in a center portion of the open/close member 18. And a bearing portion 20*a* of the pressing member 20 is inserted into the opening 18*a*.

The pressing member 20 has a press board member 20*b* having a rectangular shape the size of which corresponds to the size of the IC package 12. The bearing portion 20*a* projects from an approximately center portion of the press board portion 20*b*.

Figure 14:
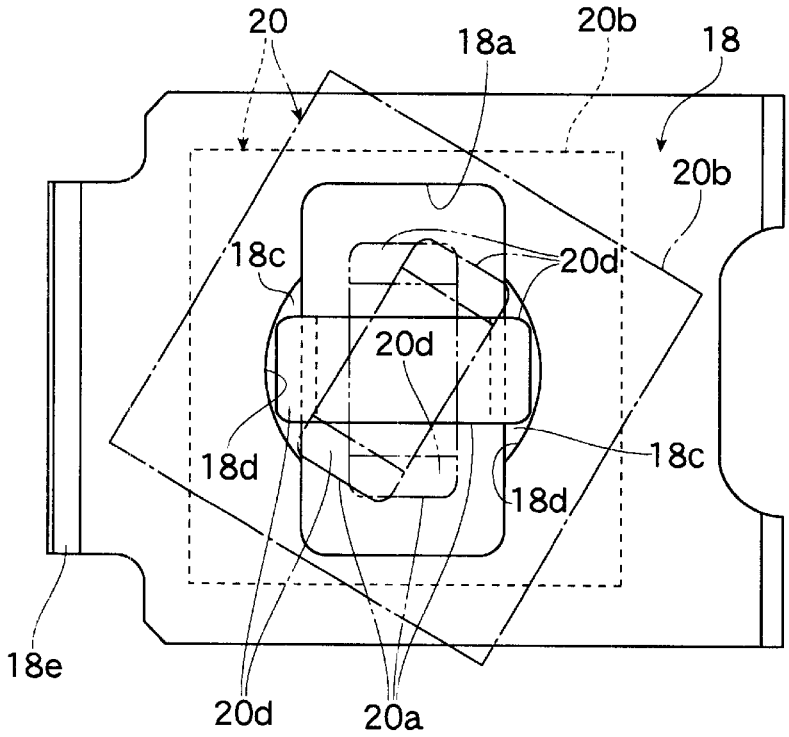
FIG. 14 is a plan view corresponding to FIG. 13 at the time when the pressing member of the IC socket of the first embodiment is rotated.

The bearing portion 20*a* has engaging portions 20*d* projecting toward outside of the sides of the bearing portion 20*a*. These engaging portion 20*d* are engaged with and supported by an engage portion 18*c* formed at the peripheral portion of the opening 18*a* of the open/close member 18. In this embodiment, the pressing member 20 is supported to be able to move vertically in relation to the open/close member 18. That is, there is a small amount of clearance in a vertical direction between the engaging portion 20*d* and the engage portion 18*c*. As shown in FIG. 14, the engaging portion 20*d* can rotate from a state of solid line, which shows a state that the engaging portion 20*d* is in an engaging state with the engage portion 18*c*, to a state shown by a long dashed short dashed line to a state of a long dashed two short dashed line, so that the engaging state can be released, followed by releasing of the engaging portion 20*d* from the opening 18*a*, and finally the pressing member 20 can be taken out from the open/close member 18. At the time when the pressing member 20 is rotating, a corner portion of the engaging portion 20*d* is guided to slide on an arcuate-like guide wall 18*d*.

The bearing portion 20*a* is provided with a slit 20*c* extending vertically at a state when the open/close member 18 is closed (the open/close member 18 is in an approximately horizontal state). A shaft 21, a portion of which is to be inserted into an insertion hole 18*b* of the open/close member 18, is inserted into the slit 20*c*. The pressing member 20 is prohibited from rotating when the shaft 21 is in a state of insertion into the slit 20*c*, to prevent the pressing member 20 from falling off from the open/close member 18. And E-rings 22 are detachably provided on the shaft at around both side portions of the open/close member 22. The shaft can be drawn off by taking out at least one of the E-rings 22.

Furthermore, the shaft 21 is to be inserted into a pair of spacers 23 having a round shape (toric shape) in cross section parallel to an orthogonal direction of the shaft 21. The pair of spacers 23 are disposed within the opening 18*a* of the open/close member 18 and at both side portions of the bearing portion 20*a* of the pressing member 20. When the upper surface of the IC package 12 is pressed by the press board portion 20*b*, an outer surface (side surface) of the spacer 23 abuts against the press board portion 20*b*. The spacer 23 can be replaced by sliding the shaft 21 into or out of the spacer 23.

Figure 2:
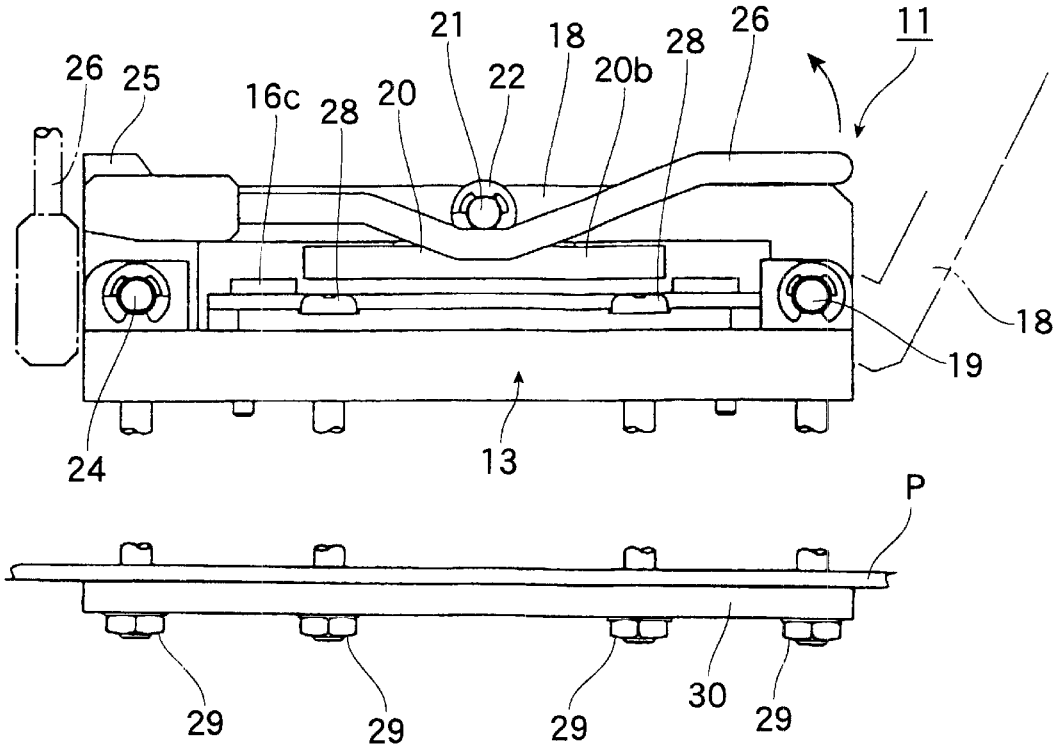
FIG. 2 is a front view of the IC socket of the first embodiment.

In addition, as shown in FIG. 1, 2 and 4, a latch member 25 is rotatably provided on a shaft 24 on the side of the base portion 15. A hook portion 25*a* provided at an endmost portion of the latch member 25 is engaged with an endmost portion 18*e* of the open/close member 18. Furthermore, rotation of an arm 26 provided rotatably on the shaft 24 allows the latch member 25 to move vertically and rotatably under an action of a mechanism not shown in this embodiment. And the latch member 25 is urged upwards by a spring 27. More precise operations will be explained hereunder.

Next, operation of the socket will be explained.

Figure 3:
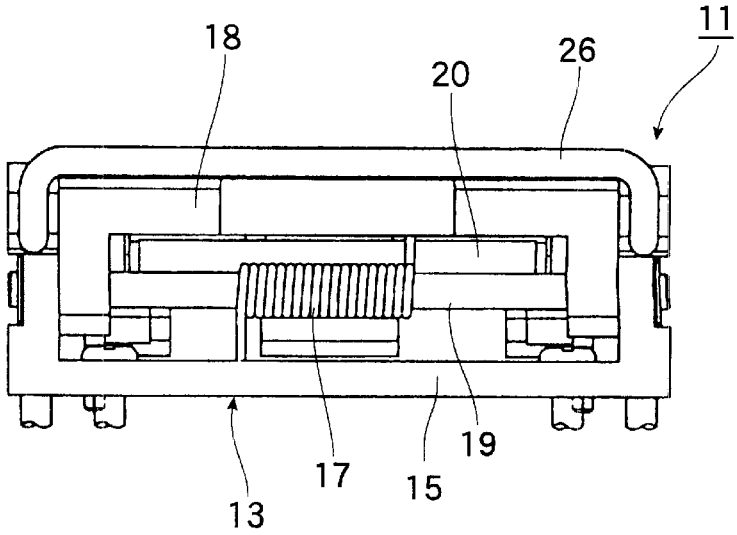
FIG. 3 is a right side view of the IC socket of the first embodiment.

The IC socket 11 is mounted beforehand on, as shown in FIGS. 2 and 3, the circuit board P via a support plate 30 by a bolt 28 and a nut 29.

As shown at lower half portion in FIG. 1, in a state where the open/close member 18 is opened, the IC package 12 is mounted on the floating plate 16, then the open/close member 18 is closed, to engage the hook portion 25*a* of the latch member 25 with the endmost portion 18*e* of the open/close member 18.

Next, as shown in FIG. 2, when the arm 26 which is in uprising position, is rotated to fall down toward an approximately horizontal position, the latch member 25 is forced to move downwards against an urging force of the spring 27, rotating and bringing the open/close member 18 to further downward position.

Force to rotate the open/close member 18 downwards is transferred to the press board portion 20*b* of the pressing member 20 via the shaft 21 and the spacer 23, resulting in a state that the package body 12*a* of the IC package 12 is pressed by the press board portion 20*b*.

The operation mentioned above makes the solder ball 12*b* of the IC package 12 contact with the contact surface portion 14*d* of the contact pin 14, with a prescribed contact pressure, establishing an electrical connection. At this time, as the solder ball 12*b* is inserted at the lower portion thereof into the ellipsoidal recess 14*e* having a minor axis narrower in width than the diameter of the solder ball 12*b*, the lowermost portion of the solder ball 12*b* can be kept from being damaged.

In addition, when the contact surface portion 14*d* of the contact pin 14 is urged downwards with the solder ball 12*b* being driven into the ellipsoidal recess 14*e*, the contact surface portion 14*d* is displaced in a deformation direction of the spring portion 14*c*. The ellipsoidal recess 14*e* is elongated along the deformation direction of the spring portion 14*e* so that the solder ball 12*b* can move within the ellipsoidal recess 14*e* in a relative displacement manner with respect to the recess 14*e*, resulting in that the displacement is allowed. Unnecessary and excessive force applying on the solder ball 12*b*, the contact pin 14*e* or the like can be eliminated. In addition, a wiping effect can be exerted because the solder ball 12*b* moves within the recess 14*e* in the relative displacement manner with respect to the ellipsoidal recess 14*e*.

As mentioned above, when the IC package 12 is accommodated on the IC socket 11, electrical contact, via the contact pin 14, between the IC package 12 and the circuit board P is established. Then the burn-in test is carried out under this condition.

On the other hand, when the IC package 12 is taken out from the IC socket 11, the arm 26 is, at first, rotated anticlockwisely in an arrow direction from a state shown in FIG. 2, to bring the arm 26 to an uprising position. The latch member 25 is moved upwards by the urging force of the spring 27 with the latch member 25 rotating anticlockwisely, resulting in that the hook portion 25*a* is released from the endmost portion 18*e* of the open/close member 18.

Thereby, the open/close member 18 is rotated and opened by the urging force of the spring 17, being able to take out the IC package 12.

Incidentally, in a case where the contact pin 14 of the IC socket 11 is damaged and needs to be replaced, the contact pin 14 can be removed upwards and taken out without dismantling the floating plate 16, by unfastening the engaging portion 14*g* from an engage portion of the lower surface portion 16*b* of the floating plate 16 with the elastic deformation portion 14*f* of the contact pin 14 being elastically deformed, as shown by a long dashed two short dashed line in FIG. 5.

On the contrary, when a new contact pin 14 is fitted, the contact pin 14 can be inserted through and fitted into each through hole 15*a*, 16*a* from upper side thereof with the elastic deformation portion 14*f* being elastically deformed.

Accordingly, the contact pin 14 can be easily removed from or installed in the socket body 13 without disassembling the base portion 15 and the floating plate 16, so that even only one of the contact pins 14 can be easily replaced.

What is more, the engaging portion 14*g* prevents the contact pin 14 from falling off.

When the contact pin 14 is driven to be inserted into each through hole 15*a*, 16*a* from upper side of the socket body 13, it may be often difficult to insert the lower end portion 14*b* of the contact pin 14 into the lower side through hole 15*a*, because the lower side through hole 15*a* is a little bit apart from the upper side through hole 16*a*, and the lower side through hole 15*a* can not be seen from naked eye.

The lower end portion 14*b* of the contact pin 14 can be, however, easily inserted into the lower side through hole 15*a*, by providing the inclined guide portion 15*b* at the upper peripheral portion of the lower side through hole 15*a*.

Next, in a case where various IC packages 12 different in thickness thereof are tested using the same IC socket 11, the pressing member has usually been replaced with another one in order to secure a prescribed contact pressure in conventional art. According to the embodiment of the present invention, however, all one needs to do is to replace the spacer 23 having different thickness t1.

More specifically, the spacer 23 can be replaced by taking out the shaft 21 after unfixing one of the E-rings 22. The pressing member 20 of the present invention does not slip off unintentionally even in a state the shaft 21 is taken out, because the engaging portion 20*d* of the pressing member 20 remains engaged with the engage portion 18*c* of the open/close member 18.

Next, the spacer 23 having a different thickness t1 is first prepared and then the shaft 21 is inserted into the spacer 23, the slit 20*c* of the pressing member 20 and the open/close member 18 respectively, and then the shaft 21 is secured by the E-ring 22.

As the spacer 23 having a thickness t1 is interposed between the shaft 21 and an upper surface of the press board portion 20*b*, a clearance between the shaft 21 and the upper surface of the pressboard portion 20*b* can be adjusted, by only replacing the spacer 23 without replacing the pressing member 20, so that the same IC socket 11 can be used for various types of IC packages 12 having different thickness, being able to secure a prescribed contact pressure.

When IC package 12 having different shape is accommodated, a pressing member 20 of the press board portion 20*b* having a corresponding shape should be used. In the present invention, however, the pressing member 20 can be easily replaced.

More specifically, the pressing member 20 is rotated by about 90° after the shaft 21 is taken out. Thereby, the engaging portion 20*d* of the pressing member 20 is released from the engage portion 18*c* of the open/close member 18 so that the engaging portion 20*d* can be taken out through the opening 18*a*. On the contrary when a new pressing member 20 is installed, the engaging portion 20*d* of the pressing member 20 is inserted into the through hole 18*a* and rotated by about 90°, and then the engaging portion 20*d* of the pressing member 20 is engaged with the engage portion 18*c* of the open/close member 18. And then the shaft 21 is inserted and finally the shaft 21 is fixed by the E-ring 22, to complete the replacing process.

As the pressing member 20 can be easily replaced as mentioned above, the same IC socket 11 can be used for various kinds of IC packages 12 having different shapes, reducing cost in process.

As the engage portion 18*c* is engaging with the engaging portion 20*d* when in use even after the shaft is taken out, the open/close member 18 dose not fall off unintentionally. Thereby, there is no need to hold the pressing member while the shaft 21 is taken out, being an easy work for replacing the pressing member 20.

Further, the pressing member 20 can be engaged or taken out by only rotating the pressing member 20, improving workability in replacing the pressing member 20. Still furthermore, since the open/close member 18 is further provided with the guide wall 18*d* having an approximately arcuate shape for guiding the pressing member 20 at the time the pressing member 20 is rotated, rotation and replacing of the pressing member 20 can be carried out more easily.

Second Embodiment

Figure 18B:
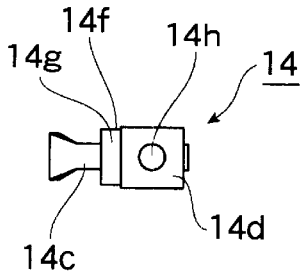
FIGS. 18A and 18B are views showing the contact pin of a second embodiment of the present invention.
Figure 18A:
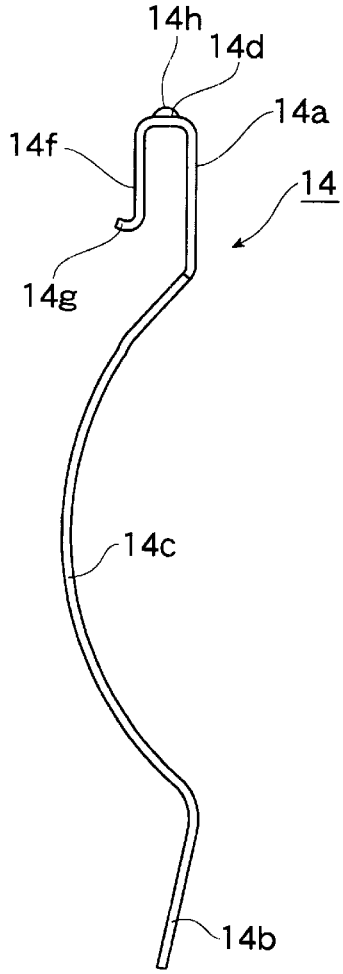
Figure 19B:
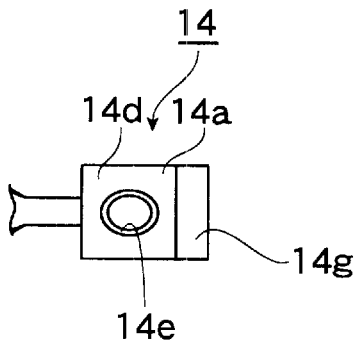
FIGS. 19A and 19B are views showing variations of an elastic deformation portion and a collar like engaging portion.
Figure 19A:
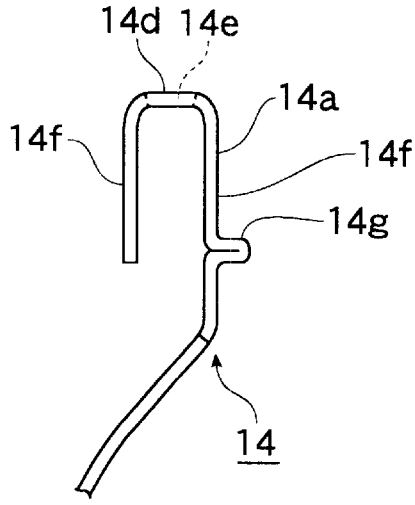
Figure 20B:
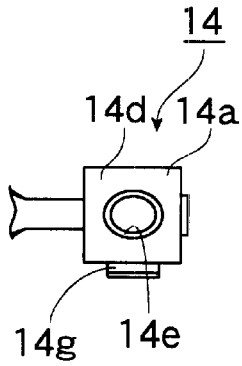
FIGS. 20A and 20B are views showing another variations of the elastic deformation portion and the collar like engaging portion.
Figure 20A:
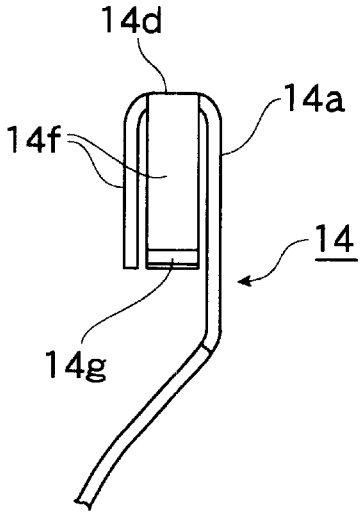
Figure 21A:
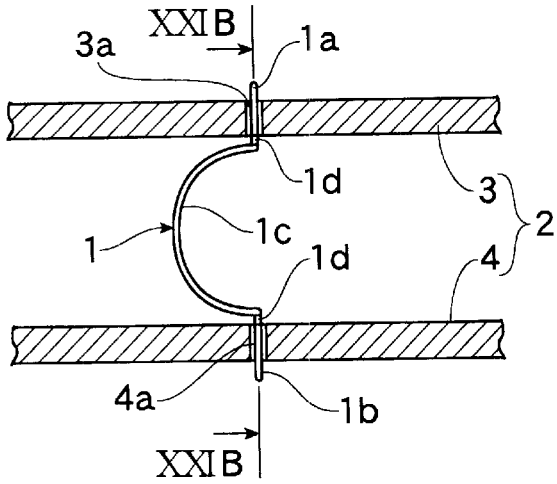
FIGS. 21A and 21B are views showing conventional art.
Figure 21B:
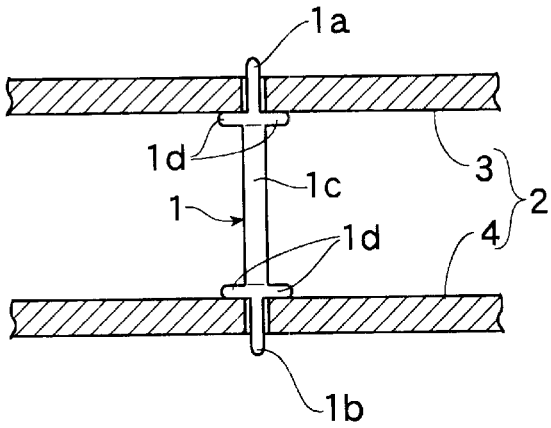
PRIOR ART FIG.21B

FIGS. 18A and 18B show a second embodiment of the present invention.

In this second embodiment, a projection 14*h* is formed on the contact surface portion 14*d* of the contact pin 14. Difference from the embodiment 1 resides in this feature.

The projection 14*h* abuts against a plate-like terminal of the LGA (Land Grid Array) type IC package, not shown in Figs. The projection 14*h* is formed on the contact surface portion 14*d* so that the contact pressure with the plate-like terminal can be secured.

In the present invention, the position of the elastic deformation portion 14*f* and the collar-like engaging portion 14*g* are not limited to the position of the first embodiment. As shown in FIG. 19A, 19B, FIG. 20A, 20B, the elastic deformation portion 14*f* and the collar-like engaging portion 14*g* can be provided at any peripheral side of the contact surface portion 14*d*. It is further to be noted that the present invention is not limited to the described embodiments and many other changes and modifications may be made without departing from the scopes of the appended claims.

What is claimed is:

1. A socket, disposed on a circuit board, for an electrical part, the socket comprising:

a socket body on which the electrical part is accommodated; and a contact pin provided in the socket body, the contact pin comprising:

an upper end portion to contact a terminal of the electrical part, a lower end portion to electrically contact the circuit board, and an elastically deformable spring portion between the upper end portion and the lower end portion, the upper end portion comprising:

a perpendicular portion extending upward from the spring portion, a horizontal portion extending in an approximately horizontal direction from an upper end portion of the perpendicular portion, and an elastic deformation portion extending downward from the horizontal portion and having an engaging projection on a front edge thereof, the socket body comprising:

an upper through hole into which the upper end portion of the contact pin is inserted from above, and a lower through hole into which the lower end portion of the contact pin is inserted, the contact pin being installed in the socket body by inserting the lower end portion thereof through the upper through hole into the lower through hole, inserting the upper end portion thereof into the upper through hole with the elastic deformation portion being deformed, and releasing the deformation of the elastic deformation portion at a time at which the inserting is completed, the engaging projection engaging with a lower surface portion of a peripheral portion of the upper through hole, to prevent the contact pin from falling through the upper through hole.

2. A socket for an electrical part according to claim 1, wherein the terminal of the electrical part has a plane like shape and the horizontal portion of the upper end portion of the contact pin comprises:

a contact surface portion extending approximately in the horizontal direction to abut against the plane like terminal of the electrical part, and a projection provided in the contact surface portion to abut against the plane like terminal.

3. A socket for electrical parts according to claim 1, wherein the lower through hole of the socket body comprises an inclined guide portion in an upper peripheral portion thereof to guide the lower end portion of the contact pin therethrough.

4. A socket for an electrical part according to claim 1, wherein the terminal of the electrical part is spherical and the horizontal portion of the upper end portion of the contact pin comprises:

a contact surface portion extending approximately in the horizontal direction to abut against the spherical terminal, and a recess portion provided in the contact surface portion to prevent a lower end portion of the spherical terminal from abutting against the contact surface portion.

5. A socket for an electrical part according to claim 4, wherein the recess portion of the upper end portion of the contact pin has an ellipsoidal shape elongated in a bending direction of the spring portion.

6. A socket, disposed on a circuit board, for an electrical part, the socket comprising:

a socket body on which the electrical part is accommodated; and a contact pin provided in the socket body, the contact pin comprising:

an upper end portion to contact a terminal of the electrical part, a lower end portion to electrically contact the circuit board, and an elastically deformable spring portion between the upper end portion and the lower end portion, the upper end portion comprising:

a perpendicular portion extending upward from the spring portion and having an engaging projection at a lower end portion thereof, a horizontal portion extending in an approximately horizontal direction from an upper end portion of the perpendicular portion, and an elastic deformation portion extending downward from the horizontal portion, the socket body comprising:

an upper through hole into which the upper end portion of the contact pin is inserted from above, and a lower through hole into which the lower end portion of the contact pin is inserted, the contact pin being installed in the socket body by inserting the lower end portion thereof through the upper through hole into the lower through hole, inserting the upper end portion thereof into the upper through hole with the elastic deformation portion being deformed, and releasing the deformation of the elastic deformation portion at a time at which the inserting is completed, the engaging projection engaging with a lower surface portion of a peripheral portion of the upper through hole, to prevent the contact pin from falling through the upper through hole.

* * * * *

UNITED STATES PATENT AND TRADEMARK OFFICE

CERTIFICATE OF CORRECTION

PATENT NO. : 6,676,418 B2
DATED : January 13, 2004
INVENTOR(S) : Tsuyoshi Watanabe It is certified that error appears in the above-identified patent and that said Letters Patent is hereby corrected as shown below:

Column 10,
Line 53, change “electrical parts” to -- an electrical part --.

Signed and Sealed this

Fifteenth Day of June, 2004

JON W. DUDAS
*Acting Director of the United States Patent and Trademark Office*